US006388213B1

(12) United States Patent
Letient et al.

(10) Patent No.: US 6,388,213 B1
(45) Date of Patent: May 14, 2002

(54) LOCKING DEVICE FOR MOLDED CASE CIRCUIT BREAKERS

(75) Inventors: Patrick Letient, Saint-Quentin (FR); Vijay Krishnan, Jalahalli West Bangalore (IN); T. K. Shachidevi, Bangalore (IN); K. V. Sridhar, Bangalore (IN); Mahesh J. Rane, Bangalore (IN); J. Narayanan, Hosure (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/621,914

(22) Filed: Jul. 24, 2000

Related U.S. Application Data

(60) Provisional application No. 60/190,294, filed on Mar. 17, 2000.

(51) Int. Cl.[7] ..... H01H 9/28

(52) U.S. Cl. ..... 200/43.15; 200/43.14

(58) Field of Search ..... 335/202; 200/43.01–43.22

(56) References Cited

U.S. PATENT DOCUMENTS

| | | | | |
|---|---|---|---|---|
| 2,340,682 A | | 2/1944 | Powell | |
| 2,719,203 A | | 9/1955 | Gelzheiser et al. | |
| 2,937,254 A | | 5/1960 | Ericson | |
| 3,158,717 A | | 11/1964 | Jencks et al. | |
| 3,162,739 A | | 12/1964 | Klein et al. | |
| 3,197,582 A | | 7/1965 | Norden | |
| 3,307,002 A | | 2/1967 | Cooper | |
| 3,312,794 A | * | 4/1967 | Hollyday | 200/43.14 |
| 3,517,356 A | | 6/1970 | Hanafusa | |
| 3,631,369 A | | 12/1971 | Menocal | |
| 3,803,455 A | | 4/1974 | Willard | |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |

(List continued on next page.)

*Primary Examiner*—Lincoln Donovan
(74) *Attorney, Agent, or Firm*—Cantor Colburn LLP

(57) ABSTRACT

The invention relates to a locking device mounted directly on a circuit breaker and configured for mounting different locks. The locking device includes a yoke member, a slider member, a handle block and a lock. When the locking device is locked, the handle block abuts the operating handle in an engaged position corresponding to the operating handle in the ON or OFF position. Thus, the locking device locks the circuit breaker in the OFF position or the ON position. The locking device may further comprise a base member disposed between the yoke member and the housing. When it is desired to lock the circuit breaker in the on position, the base member is adapted to cover the push-to-trip button on the housing.

34 Claims, 4 Drawing Sheets

U.S. PATENT DOCUMENTS

| | | | | |
|---|---|---|---|---|
| 3,883,781 | A | | 5/1975 | Cotton |
| 4,129,762 | A | | 12/1978 | Bruchet |
| 4,144,513 | A | | 3/1979 | Shafer et al. |
| 4,158,119 | A | | 6/1979 | Krakik |
| 4,165,453 | A | | 8/1979 | Hennemann |
| 4,166,988 | A | | 9/1979 | Ciarcia et al. |
| 4,220,934 | A | | 9/1980 | Wafer et al. |
| 4,255,732 | A | | 3/1981 | Wafer et al. |
| 4,259,651 | A | | 3/1981 | Yamat |
| 4,263,492 | A | | 4/1981 | Maier et al. |
| 4,276,527 | A | | 6/1981 | Gerbert-Gaillard et al. |
| 4,297,663 | A | | 10/1981 | Seymour et al. |
| 4,301,342 | A | | 11/1981 | Castonguay et al. |
| 4,360,852 | A | | 11/1982 | Gilmore |
| 4,368,444 | A | | 1/1983 | Preuss et al. |
| 4,375,021 | A | | 2/1983 | Pardini et al. |
| 4,375,022 | A | | 2/1983 | Daussin et al. |
| 4,376,270 | A | | 3/1983 | Staffen |
| 4,383,146 | A | | 5/1983 | Bur |
| 4,392,036 | A | | 7/1983 | Troebel et al. |
| 4,393,283 | A | | 7/1983 | Masuda |
| 4,401,872 | A | | 8/1983 | Boichot-Castagne et al. |
| 4,409,573 | A | | 10/1983 | DiMarco et al. |
| 4,435,690 | A | | 3/1984 | Link et al. |
| 4,467,297 | A | | 8/1984 | Boichot-Castagne et al. |
| 4,468,645 | A | | 8/1984 | Gerbert-Gaillard et al. |
| 4,470,027 | A | | 9/1984 | Link et al. |
| 4,479,143 | A | | 10/1984 | Watanabe et al. |
| 4,488,133 | A | | 12/1984 | McClellan et al. |
| 4,492,941 | A | | 1/1985 | Nagel |
| 4,541,032 | A | | 9/1985 | Schwab |
| 4,546,224 | A | | 10/1985 | Mostosi |
| 4,550,360 | A | | 10/1985 | Dougherty |
| 4,562,419 | A | | 12/1985 | Preuss et al. |
| 4,589,052 | A | | 5/1986 | Dougherty |
| 4,595,812 | A | | 6/1986 | Tamaru et al. |
| 4,611,187 | A | | 9/1986 | Banfi |
| 4,612,430 | A | | 9/1986 | Sloan et al. |
| 4,616,198 | A | | 10/1986 | Pardini |
| 4,622,444 | A | | 11/1986 | Kandatsu et al. |
| 4,631,625 | A | | 12/1986 | Alexander et al. |
| 4,642,431 | A | | 2/1987 | Tedesco et al. |
| 4,644,438 | A | | 2/1987 | Puccinelli et al. |
| 4,649,247 | A | | 3/1987 | Preuss et al. |
| 4,658,322 | A | | 4/1987 | Rivera |
| 4,672,501 | A | | 6/1987 | Bilac et al. |
| 4,675,481 | A | | 6/1987 | Markowski et al. |
| 4,682,264 | A | | 7/1987 | Demeyer |
| 4,689,712 | A | | 8/1987 | Demeyer |
| 4,694,373 | A | | 9/1987 | Demeyer |
| 4,710,845 | A | | 12/1987 | Demeyer |
| 4,717,985 | A | | 1/1988 | Demeyer |
| 4,733,029 | A | * | 3/1988 | Kobayashi et al. ..... 200/43.15 |
| 4,733,211 | A | | 3/1988 | Castonguay et al. |
| 4,733,321 | A | | 3/1988 | Lindeperg |
| 4,764,650 | A | | 8/1988 | Bur et al. |
| 4,768,007 | A | | 8/1988 | Mertz et al. |
| 4,780,786 | A | | 10/1988 | Weynachter et al. |
| 4,831,221 | A | | 5/1989 | Yu et al. |
| 4,870,531 | A | | 9/1989 | Danek |
| 4,883,931 | A | | 11/1989 | Batteux et al. |
| 4,884,047 | A | | 11/1989 | Baginski et al. |
| 4,884,164 | A | | 11/1989 | Dziura et al. |
| 4,900,882 | A | | 2/1990 | Bernard et al. |
| 4,910,485 | A | | 3/1990 | Bolongeat-Mobleu et al. |
| 4,914,541 | A | | 4/1990 | Tripodi et al. |
| 4,916,420 | A | | 4/1990 | Bartolo et al. |
| 4,916,421 | A | | 4/1990 | Pardini et al. |
| 4,926,282 | A | | 5/1990 | McGhie |
| 4,935,590 | A | | 6/1990 | Malkin et al. |
| 4,937,706 | A | | 6/1990 | Schueller et al. |
| 4,939,492 | A | | 7/1990 | Raso et al. |
| 4,943,691 | A | | 7/1990 | Mertz et al. |
| 4,943,888 | A | | 7/1990 | Jacob et al. |
| 4,950,855 | A | | 8/1990 | Bolonegeat-Mobleu et al. |
| 4,951,019 | A | | 8/1990 | Gula |
| 4,952,897 | A | | 8/1990 | Barnel et al. |
| 4,958,135 | A | | 9/1990 | Baginski et al. |
| 4,965,543 | A | | 10/1990 | Batteux |
| 4,983,788 | A | | 1/1991 | Pardini |
| 5,001,313 | A | | 3/1991 | Leclerq et al. |
| 5,004,878 | A | | 4/1991 | Seymour et al. |
| 5,029,301 | A | | 7/1991 | Nebon et al. |
| 5,030,804 | A | | 7/1991 | Abri |
| 5,057,655 | A | | 10/1991 | Kersusan et al. |
| 5,077,627 | A | | 12/1991 | Fraisse |
| 5,083,081 | A | | 1/1992 | Barrault et al. |
| 5,095,183 | A | | 3/1992 | Raphard et al. |
| 5,103,198 | A | | 4/1992 | Morel et al. |
| 5,113,043 | A | * | 5/1992 | Morris ..... 200/43.11 |
| 5,115,371 | A | | 5/1992 | Tripodi |
| 5,120,921 | A | | 6/1992 | DiMarco et al. |
| 5,132,865 | A | | 7/1992 | Mertz et al. |
| 5,138,121 | A | | 8/1992 | Streich et al. |
| 5,140,115 | A | | 8/1992 | Morris |
| 5,153,802 | A | | 10/1992 | Mertz et al. |
| 5,155,315 | A | | 10/1992 | Malkin et al. |
| 5,166,483 | A | | 11/1992 | Kersusan et al. |
| 5,172,087 | A | | 12/1992 | Castonguay et al. |
| 5,178,504 | A | | 1/1993 | Falchi |
| 5,184,717 | A | | 2/1993 | Chou et al. |
| 5,187,339 | A | | 2/1993 | Lissandrin |
| 5,198,956 | A | | 3/1993 | Dvorak |
| 5,200,724 | A | | 4/1993 | Gula et al. |
| 5,210,385 | A | | 5/1993 | Morel et al. |
| 5,239,150 | A | | 8/1993 | Bolongeat-Mobleu et al. |
| 5,256,838 | A | * | 10/1993 | Benda ..... 200/43.13 |
| 5,260,533 | A | | 11/1993 | Livesey et al. |
| 5,262,744 | A | | 11/1993 | Arnold et al. |
| 5,280,144 | A | | 1/1994 | Bolongeat-Mobleu et al. |
| 5,281,776 | A | | 1/1994 | Morel et al. |
| 5,296,660 | A | | 3/1994 | Morel et al. |
| 5,296,664 | A | | 3/1994 | Crookston et al. |
| 5,298,874 | A | | 3/1994 | Morel et al. |
| 5,300,907 | A | | 4/1994 | Nereau et al. |
| 5,310,971 | A | | 5/1994 | Vial et al. |
| 5,313,180 | A | | 5/1994 | Vial et al. |
| 5,317,471 | A | | 5/1994 | Izoard et al. |
| 5,331,500 | A | | 7/1994 | Corcoles et al. |
| 5,334,808 | A | | 8/1994 | Bur et al. |
| 5,341,191 | A | | 8/1994 | Crookston et al. |
| 5,347,096 | A | | 9/1994 | Bolongeat-Mobleu et al. |
| 5,347,097 | A | | 9/1994 | Bolongeat-Mobleu et al. |
| 5,349,145 | A | * | 9/1994 | Kelaita, Jr. et al. ..... 200/43.15 |
| 5,350,892 | A | | 9/1994 | Rozier |
| 5,357,066 | A | | 10/1994 | Morel et al. |
| 5,357,068 | A | | 10/1994 | Rozier |
| 5,357,394 | A | | 10/1994 | Piney |
| 5,361,052 | A | | 11/1994 | Ferullo et al. |
| 5,373,130 | A | | 12/1994 | Barrault et al. |
| 5,379,013 | A | | 1/1995 | Coudert |
| 5,424,701 | A | | 6/1995 | Castonguary et al. |
| 5,438,176 | A | | 8/1995 | Bonnardel et al. |
| 5,440,088 | A | | 8/1995 | Coudert et al. |
| 5,449,871 | A | | 9/1995 | Batteux et al. |
| 5,450,048 | A | | 9/1995 | Leger et al. |
| 5,451,729 | A | | 9/1995 | Onderka et al. |
| 5,457,295 | A | | 10/1995 | Tanibe et al. |
| 5,467,069 | A | | 11/1995 | Payet-Burin et al. |
| 5,469,121 | A | | 11/1995 | Payet-Burin |
| 5,475,558 | A | | 12/1995 | Barjonnet et al. |

| | | | | | |
|---|---|---|---|---|---|
| 5,477,016 | A | | 12/1995 | Baginski et al. | |
| 5,479,143 | A | | 12/1995 | Payet-Burin | |
| 5,483,212 | A | | 1/1996 | Lankuttis et al. | |
| 5,485,343 | A | | 1/1996 | Santos et al. | |
| D367,265 | S | | 2/1996 | Yamagata et al. | |
| 5,493,083 | A | | 2/1996 | Olivier | |
| 5,504,284 | A | | 4/1996 | Lazareth et al. | |
| 5,504,290 | A | | 4/1996 | Baginski et al. | |
| 5,510,761 | A | | 4/1996 | Boder et al. | |
| 5,512,720 | A | | 4/1996 | Coudert et al. | |
| 5,515,018 | A | | 5/1996 | DiMarco et al. | |
| 5,519,561 | A | | 5/1996 | Mrenna et al. | |
| 5,534,674 | A | | 7/1996 | Steffens | |
| 5,534,832 | A | | 7/1996 | Duchemin et al. | |
| 5,534,835 | A | | 7/1996 | McColloch et al. | |
| 5,534,840 | A | | 7/1996 | Cuingnet | |
| 5,539,168 | A | | 7/1996 | Linzenich | |
| 5,543,595 | A | | 8/1996 | Mader et al. | |
| 5,552,755 | A | | 9/1996 | Fello et al. | |
| 5,581,219 | A | | 12/1996 | Nozawa et al. | |
| 5,604,656 | A | | 2/1997 | Derrick et al. | |
| 5,608,367 | A | | 3/1997 | Zoller et al. | |
| 5,784,233 | A | | 7/1998 | Bastard et al. | |
| 5,905,236 | A | * | 5/1999 | Green | 200/43.14 |

FOREIGN PATENT DOCUMENTS

| | | |
|---|---|---|
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| WO | 92/00598 | 1/1992 |
| WO | 92/05649 | 4/1992 |
| WO | 94/00901 | 1/1994 |

* cited by examiner

LOCKING DEVICE FOR MOLDED CASE CIRCUIT BREAKERS

CROSS REFERENCE TO RELATED APPLICATIONS

This application is based upon, and claims the benefit of, U.S. Provisional Patent Application No. 60/190,294 filed on Mar. 17, 2000, which is herein incorporated by reference in its entirety.

BACKGROUND OF THE INVENTION

The present invention relates generally to the field of circuit breakers and, more particularly, to a locking device for locking the circuit breaker handle in either an on or an off position.

It is frequently necessary to ensure that electrical equipment cannot be operated, for example while maintenance work is being carried out. It is essential to ensure that circuit breakers associated with the equipment are secured in the OFF position to avoid inadvertent operation that can lead to unplanned personnel exposure or equipment damage. Also, it is also often necessary to ensure that equipment is secured in the ON position, to prevent accidental shutdown of machinery, such as refrigeration equipment, life support systems, fire protection devices and continuous processes which require 1–2 days to start (e.g. cement manufacturing). Therefore, the ability to lock the circuit breaker in either the off or the on position is desirable. Further, when the circuit breaker is locked in the on position, an unintentional or purposeful trip of the circuit breaker caused by the pressing of a trip test button is undesirable. In such an instance, an electrical unit is needlessly shut down causing unnecessary time delays and costly down time.

SUMMARY OF THE INVENTION

In an exemplary embodiment of the invention, a locking device for use on a circuit breaker having a housing and an operating handle. The locking device comprising a yoke member fixedly attached to the housing, a slider member slidably engaged to the yoke member, a handle block depending from the slider member and positioned to abut the operating handle in an engaged position, and a first lock arranged to secure the slider member and the handle block in the engaged position. When the locking device is locked, the handle block abuts the operating handle in an engaged position corresponding to the operating handle in the ON or OFF position. Thus, the locking device locks the circuit breaker in the OFF position or the ON position. The locking device may further comprise a base member disposed between the yoke member and the housing. When it is desired to lock the circuit breaker in the on position, the base member is adapted to cover the push-to-trip button on the housing.

DETAILED DESCRIPTION OF THE INVENTION

Figure 1:
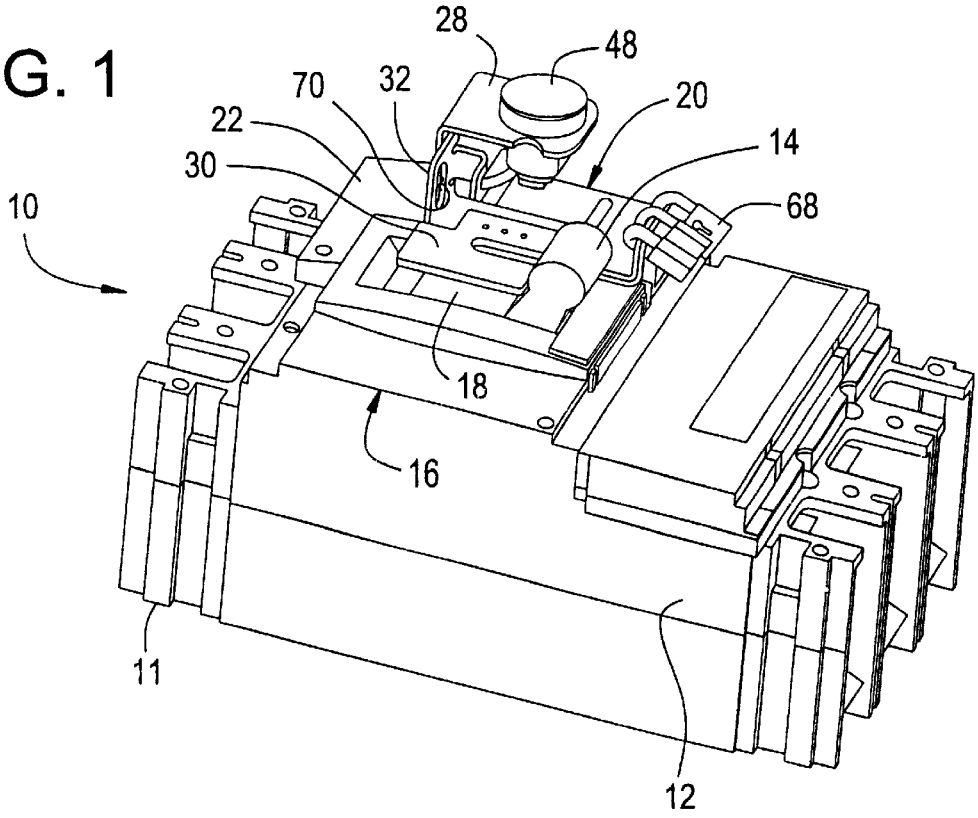
FIG. 1 is an isometric view of a circuit breaker in the off position including the locking device of the present invention.

Referring to FIG. 1, a circuit breaker 10 is shown in the OFF position. Circuit breaker 10 includes a housing, shown generally at 16. Housing 16 contains mechanical operating components within a circuit breaker case (housing) 11 and electronic components within a circuit breaker cover 12. The circuit breaker cover 12 is securely fastened to the circuit breaker case 11. A top cover (not shown) attached to the circuit breaker cover 12 protects the electronic components from the environment. An operating handle 14 extends through an opening 18 in the circuit breaker cover 12. The handle 14 is movable between an OFF position, at one end of the opening 18, to an ON position, at the opposite end of the opening 18. Moving the handle 14 to the OFF position separates a pair of main contacts (not shown) within the circuit breaker 10 to stop the flow of electrical current through the main contacts. Moving the handle 14 to the ON position brings the main contacts into contact to allow the electrical current to flow through the main contacts to a protected load.

Figure 2:
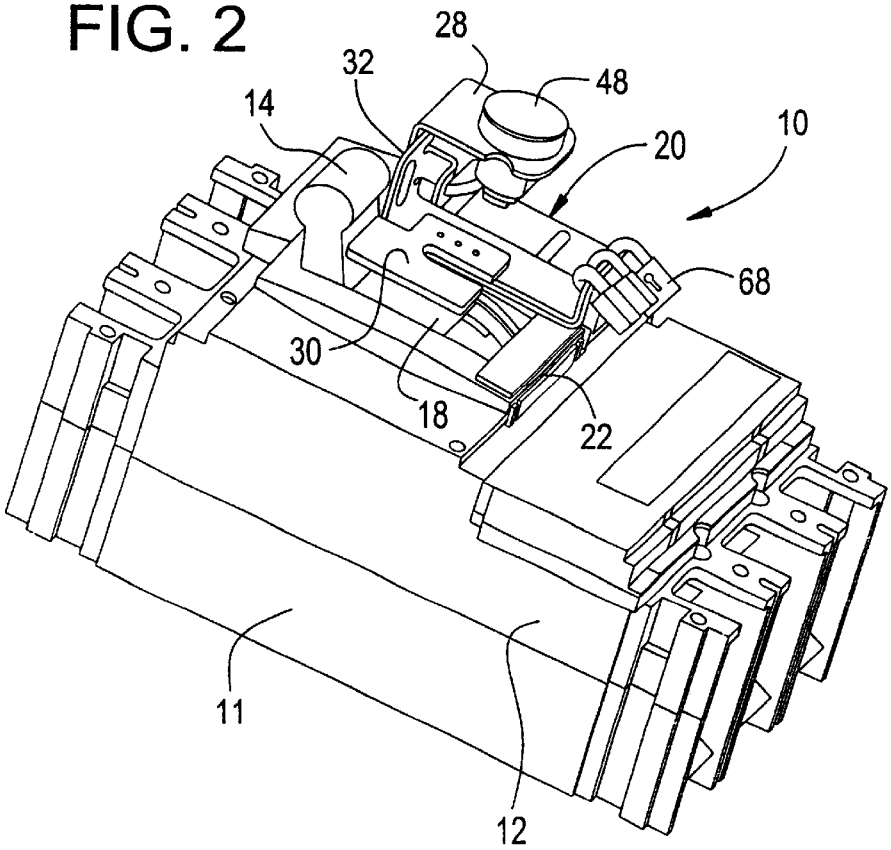
FIG. 2 is an isometric view of a circuit breaker in the on position including the locking device of FIG. 1.

A "push to trip" button 70 is located on the circuit breaker cover 12 adjacent the opening 18. Pressing the "push to trip" button causes the operating mechanism (not shown) within case 11 to trip and separate the main contacts (not shown) stopping the flow of electric current to the protected load. The design and operation of the circuit breaker 10 is known in the art. A locking device 20 is secured to the circuit breaker cover 12. Locking device 20 locks the handle 14 in either the OFF position, as shown in FIG. 1, or the ON position, as shown in FIG. 2. Locking device 20 includes a base member 22, a slider member 32, a yoke member 28, a handle block 30 and a figure lock 48.

Figure 3:
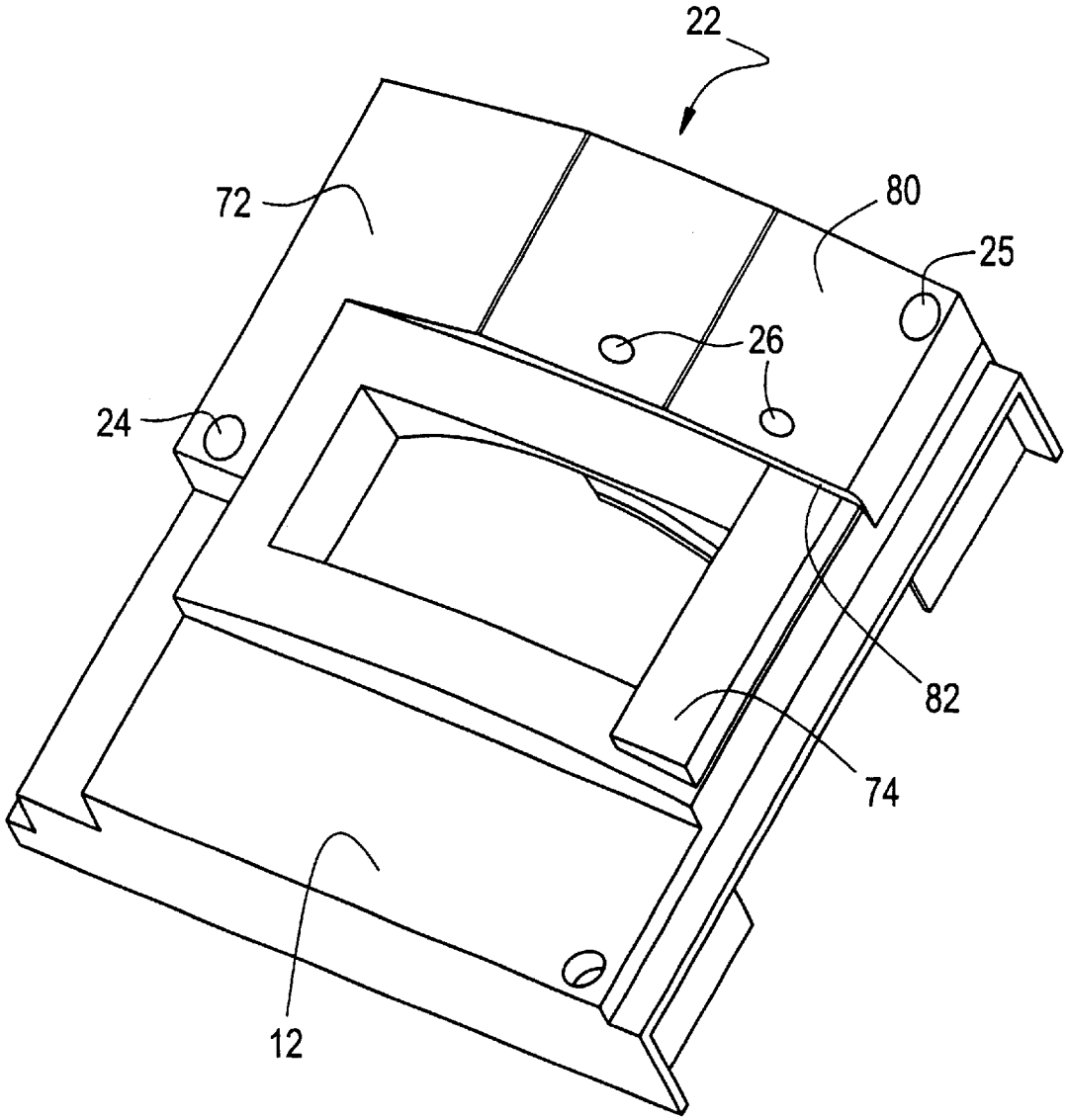
FIG. 3 is an isometric view of the base member of the locking device of FIG. 1 and the top cover of the circuit breaker of FIG. 1.

Referring to FIG. 3, the base member 22 is generally planar and includes a platform 80, a first arm 72 and a second arm 74. First arm 72 is attached to and projects outward from one end of platform 80. Second arm 74 is attached to and projects outward from the opposite end of platform 80. First arm 72 and second arm 74 projects outward from platform 80 in the same general direction. First arm 72 includes a first aperture 24 located at an end of the first arm 72. Platform 80 includes a second aperture 25 located in an outward comer of the platform 80 proximate to the second arm 74. Mechanical fasteners are inserted through apertures 24, 25 and corresponding apertures (not shown) on the circuit breaker cover 12 (FIG. 1) to fixedly attach the base member 22 to the circuit breaker cover 12. The base member 22 is preferably made of a plastic material. Second arm 74 further includes lines of weakness such that the second arm 74 can be manually removed from the platform 80, preferably at an edge 82. Edge 82 is generally located where the second arm 74 attaches to platform 80.

Figure 4:
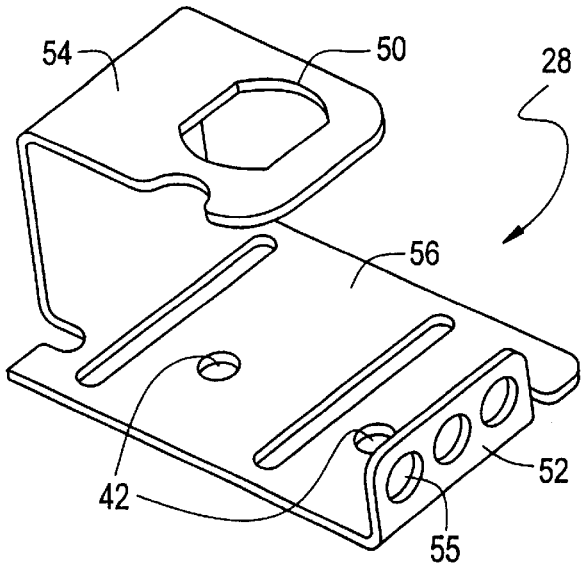
FIG. 4 is an isometric view of the yoke member of the locking device of FIG. 1.

Referring to FIG. 4, yoke member 28 is shown having apertures 42 spaced apart and located in a base section 56. Yoke member 28 is fixedly attached to base member 22 by inserting mechanical fasteners, preferably screws, through apertures 26 of base member 22 (FIG. 3) and apertures 42. Yoke member 28 has a first leg 52 and a generally L-shaped second leg 54. First leg 52 and second leg 54 extend outward from base section 56 in the same general direction. Second leg 54 has an aperture 50 configured to receive a lock. First leg 52 has three padlock apertures 55. Padlock apertures 55 are spaced apart such that there is sufficient space between them to accommodate three padlocks (not shown). It is understood and within the scope of this invention that additional padlock apertures 55 can be employed to accommodate additional padlocks.

Referring to FIGS. 3 and 4, yoke member 28 is assembled to the base member 22. Yoke member 28 covers the second aperture 25 of the base member 22. First aperture 24 is not covered. Therefore, the yoke member 28 covers access to the mechanical fasteners used to fasten the base member 22 to the circuit breaker cover 12. Thus, when the locking device 20 (FIG. 1) is intentionally locked, tampering with the locking device 20 is prevented.

Figure 5:
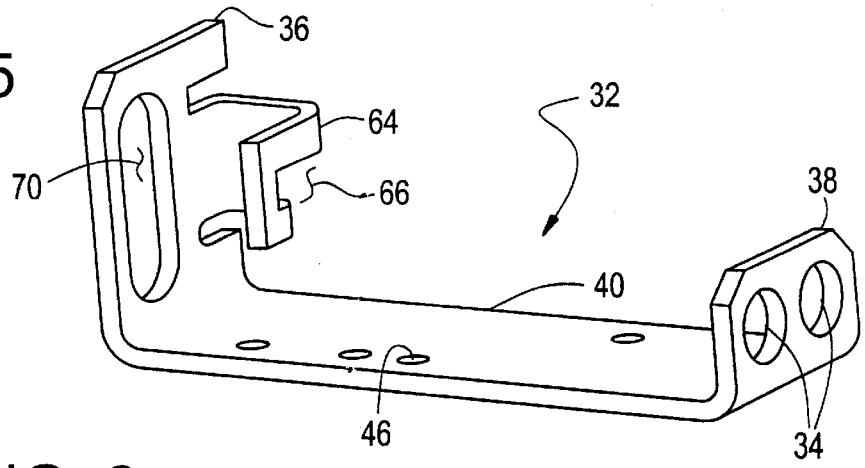
FIG. 5 is an isometric view of the slider member of the locking device of FIG. 1.

Referring to FIG. 5, a slider member 32 includes a first leg 36, second leg 38 and a base portion 40. Base portion 40 has three apertures 46 generally lined up along an edge of the base portion 40. Second leg 38 has two padlock apertures 34. First leg 36 and second leg 38 extend generally perpendicularly outward from the base portion 40 and in the same general direction. First leg 36 includes an opening, preferably elongated, 70. Opening 70 employs additional padlocks (not shown). An arm 64 extends from first leg 36 of slider member 32 and includes an aperture 66. Arm 64 is generally bent towards the first leg 36.

Referring to FIGS. 4 and 5, slider member 32 is arranged to overlie said yoke member 28 for slidable movement. Further, slider member 32 covers access to the mechanical fasteners inserted through apertures 42 of the yoke member 28 and apertures 26 (FIG. 3) of the base member 22 (FIG. 3) in order to fasten the yoke member 28 to the base member 22. Therefore, when the locking device 20 is intentionally locked, tampering with the locking device 20 is prevented.

Figure 6:
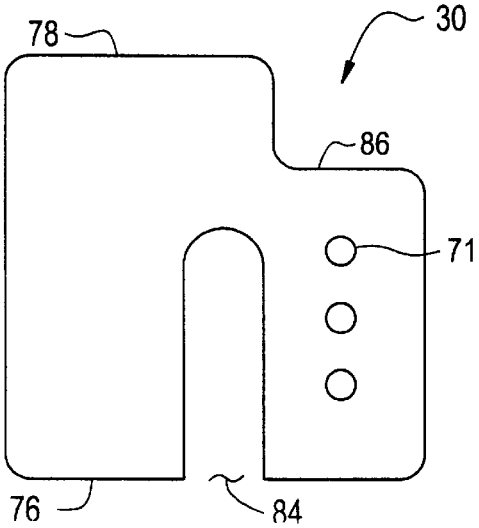
FIG. 6 is a top view of the handle block of the locking device of FIG. 1.

Referring to FIG. 6, a handle block 30, preferably flat and thin in shape, is shown having three apertures 71 and a slot 84. Slot 84 provides access to mechanical fasteners inserted through apertures 42 of yoke member 28 when locking device 20 is in the unlocked condition. Handle block 30 further includes a first end 76 and a second end 78. Second end 78 includes an L-shaped bend. Second end 78 ensures that the locking device 20 is locked only in the OFF position or the ON position by obstructing (the slider 32 connected to handle block 30 cannot be slid on yoke 28 unless the handle 14 is in the intended position of locking since it is obstructed by the projection second leg 78 or first end 76. E.g. when the lock is configured for locking in OFF position and attempted to be used for locking in the ON position) handle 14.

Referring to FIGS. 5 and 6, the arrangement of the slider member 32 and the handle block 30 is described. One aperture 71 of handle block 30 selectively aligns with one aperture 46 of slider member 32. Mechanical fasteners are inserted through apertures 72 and extend through corresponding selected aligned apertures 46 of slider member 32. Handle block 30 is positioned such that first end 76 abuts handle 14 (FIG. 1) when handle 14 is in the OFF position and second end 78 abuts handle 14 when handle 14 is in the ON position. By changing the position of the handle block 30 relative to the slider member 32, the operating handle 14 will be locked in either the OFF position or the ON position.

Figure 7:
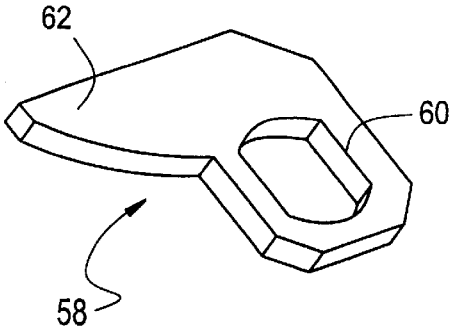
FIG. 7 is an isometric view of the cam link of the locking device of FIG. 1.

Referring to FIG. 7, a cam link 58 is shown with an aperture 60 and a first end 62. Cam link 58 is part of the locking device 20 (FIG. 1). Referring to FIGS. 5 and 7, first end 62 of cam link 58 is arranged to for insertion into aperture 66 of arm 64 of slider member 32. Thus, the slider member 32 and the handle block 30 attached to slider member 32 are engagingly attached to the cam link 58.

Figure 8:
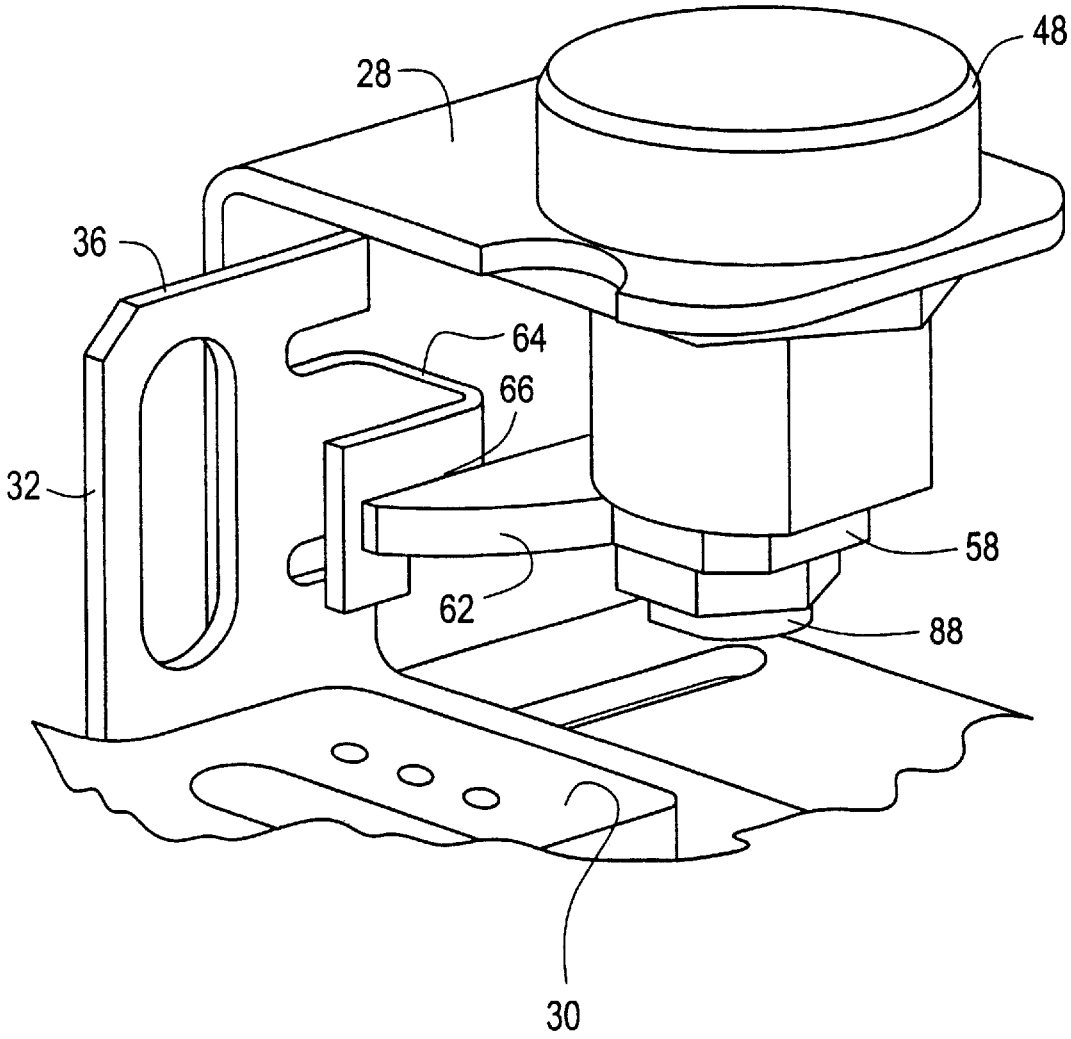
FIG. 8 is an isometric view of the slider member, yoke member, cam link, figure lock and nut of the locking device of FIG. 1.

Referring to FIG. 8, the yoke member 28 and the slider member 32 are shown assembled with the cam link 58. The first leg 36 and base portion 30 of slider member 32 are positioned proximate to the yoke member 28 and in slidably contact with yoke member 28. A nut 88, or other similar mechanical fastener, holds the first arm 62 of cam link 58 in aperture 66.

The manner in which the operating handle 14 is locked in the desired OFF or ON position will now be described in reference to FIGS. 1, 4 and 7. To lock the operating handle 14 in the desired position, slider member 32 and handle block 30 must be slidably positioned to abut the operating handle 14 as described herein above. The slider member 32 and the handle block 30 must then be prevented from slidable motion. A lock 48, preferably a figure lock such as sold under the trade name Ronis 1104 and Profalux B24, is used to prevent the slidable motion of the slider member 32 and handle block 30. A figure lock is a type of lock readily available from companies, such as Castell. The figure lock is a radial pin tumbler lock with up to three raised alphanumeric symbols on the lock face. These symbols must mate with a mirror image of them machined into the face of a key in order for the key to depress the radial pins and allow the key to rotate the lock center. The figure lock center is available in brass/mazak (a zinc alloy) or stainless steel and is therefore ideally suited for use in harsh or corrosive environments. The figure lock is available with a grand master or part master. Lock 48 is inserted through aperture 50 of yoke member 28 and extends through aperture 60 of cam link 58. First end 62 of cam link 58 is configured to fit into aperture 66 to prevent movement of the slider member 32 when the lock 48 is installed. Further, the cam link 58 permits lock 48 to be mounted onto the locking device 20. Therefore, once the lock 48 is installed, the slider member 32 is prevented from movement. The handle block 30 connected to the slider member is also prevented from movement.

As described above in reference to FIG. 6, the handle block 30 is positioned to abut either the first end 76 or the second end 78 depending on whether it is desired to lock the circuit breaker 10 (FIG. 1) in either the OFF position (shown in FIG. 1) or the ON position (shown in FIG. 2). Since the handle block 30 is locked in the selected position relative to the handle 14, the handle 14 will be locked in the desired OFF or ON position.

Referring to FIG. 1, as an alternative to securing the locking device 20 with lock 48, a padlock 68 may be used, preferably of 5–8 mm in diameter. Padlock 68 is positioned through padlock apertures 55 of the yoke member 28 that are aligned with corresponding padlock apertures 34 of the second leg 38 of slider member 32. Padlock apertures 55 and padlock apertures 34 are sufficiently spaced apart from one another such that one to three padlocks 68 may be inserted through each respective padlock aperture 55 and corresponding padlock aperture 34. Thus, the use of padlock 68, similar to lock 48, prevents the slider member 32 and the handle block 30 from slidable motion when the operating handle 14 is locked in the desired ON or OFF position. An authorized user may remove the padlocks 68 or unlock the locks 48 as desired and reconfigure the locking device 20 to switch the circuit breaker 10 from the OFF position to the ON position or visa versa. Locks 48 are unlocked by the authorized user through insertion of a key that disengages the cam link 58 from aperture 66 of arm 64 of slider member 32. Once unlocked, the slider member 32 is slid on the yoke member 28 in order to move the handle block 30 such that handle 14 is free to switch the circuit breaker 10 ON or OFF. The locking device 20 is then repositioned. The locking device may be re-assembled only if the user wishes to change the mode of locking (from ON to OFF or from OFF to ON).

When the circuit breaker 10 is locked in the ON position with the locking device 20 of the present invention, the "push to trip" button 70 located on circuit breaker cover 12 is preferably covered by the second arm 74 of base member 22. When the circuit breaker is intentionally locked in the ON position, the ability to access and push the "push to trip" button would defeat the purpose of having the handle 14 locked in the ON position. Thus, when the circuit breaker 10 is intentionally locked in the ON position, the "push to trip" button 70 cannot be pressed and the circuit breaker cannot revert to the OFF position. It should be noted that if the circuit breaker 10 is intentionally locked in the OFF position, second arm 74 of base member 22 is easily removed by authorized field personnel exposing the push to trip button 70. This is accomplished by manually breaking off the second arm by bending second arm relative to base member 22 at edge 82 that is of a reduced thickness defining the lines of weakness that are formed within the second arm. The reduced thickness forming edge 82 allows separation of second arm 74 from base member 22 at edge 82 because of the elimination of material at edge 82 that define the lines of weakness.

As described herein, the locking device 20 is versatile so that it may be used for locking the handle 14 of the circuit breaker 10 in either the ON position or the OFF position. The locking device 20 is mounted directly on the circuit breaker and authorized users can be readily unlock the selected locks and convert from the OFF position to the ON position or visa versa. Further, all mechanical fasteners holding the locking device 20 to the circuit breaker cover 12 are covered thereby preventing unauthorized tampering with the locking device 20. Another feature of the present invention is the built-in safety provision within the base member to avoid accidental or purposeful tripping of the circuit breaker 10 when it is locked in the ON position.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

What is claimed is:

1. A locking device for use on a circuit breaker having a housing and an operating handle movable between an ON position and an OFF position, the locking device comprising:

a yoke member fixedly attached to the housing;

a slider member slidably attached to said yoke member;

a handle block depending from said slider member, said handle block positioned to abut the operating handle in an engaged position and disengage the operating handle in a disengaged position; and a first lock arranged to secure said slider member and said handle block in the engaged position, wherein said slider member includes a base, a first leg extending from said base, and an arm extending from said first leg, said arm having an aperture and further including a cam link having a first end, said cam link operably connected to said first lock, wherein said aperture in said arm of said slider member configured to receive said first end of said cam link.

2. The locking device of claim 1 wherein said handle block is positioned to abut the operating handle in at least a first and a second engaged position, wherein said handle block prevents the operating handle from moving from the ON position to the OFF position when said handle block is in the first engaged position and prevents the operating handle from moving from the OFF position to the ON position when said handle block is in the second engaged position.

3. The locking device of claim 1 wherein said yoke member includes a first aperture and said first lock is mounted within said first aperture of said yoke member.

4. The locking device of claim 1 further including a base member disposed between said yoke member and the housing, said base member adapted to cover a push-to-trip button on the housing, wherein said base member prevents said push-to-trip button from being depressed.

5. The locking device of claim 1 wherein said arm is U-shaped and inwardly extending.

6. The locking device of claim 4 wherein said base member is formed from plastics material.

7. The locking device of claim 6 wherein said base member includes a first arm extending from one end of said base member and a second arm extending from an opposite end of said base member, said second arm covers said push-to-trip button on the housing, wherein said second arm contains lines of weakness for removing said second arm from said base member.

8. The locking device of claim 7 wherein said second arm is planar.

9. The locking device of claim 1 wherein said first lock is a figure lock.

10. The locking device of claim 1 wherein said yoke member includes a base section and a first leg extending from said base section, said first leg having a first padlock aperture, and further wherein said slider member includes a second leg having a first padlock aperture configured to align with said first padlock aperture in said yoke member for receiving said first lock for securing said slider member and said handle block in the engaged position.

11. The locking device of claim 10 wherein said first lock is a padlock.

12. The locking device of claim 1 wherein said handle block includes an aperture and wherein said slider member includes an aperture, said aperture in said handle block configured to align with said aperture in said slider member for insertion of a mechanical fastener.

13. The locking device of claim 1 wherein said cam link includes an aperture, said first lock inserted through said aperture of said cam link.

14. The locking device of claim 1 further including a fastener connected to said cam link, said fastener arranged to secure said first end of said cam link in said first aperture of said arm.

15. The locking device of claim 1 wherein said handle block having a plurality of apertures and said slider member having a plurality of apertures wherein one of said plurality of apertures in said slider member selectively aligned with one of said plurality of apertures in said handle block to abut said handle block against the operating handle in the engaged position.

16. The locking device of claim 4 wherein said base member having an aperture for receiving a mechanical fastener to fixedly attach said base member to the housing and further wherein said yoke member covers said aperture of said base member to prevent access to said aperture of said base member when the locking device is locked in the engaged position.

17. The locking device of claim 4 wherein said yoke member having an aperture for receiving a mechanical fastener to fixedly attach said yoke member to said base member and further wherein said slider member covers said aperture of said yoke member to prevent access to said aperture of said yoke member when the locking device is locked in the engaged position.

18. A circuit breaker comprising:

a housing;

an operating handle, extending outwardly from the housing, movable between an ON position and an OFF position; and a locking device including:

a yoke member fixedly attached to the housing;

a slider member slidably attached to said yoke member;

a handle block depending from said slider member, said handle block positioned to abut the operating handle in an engaged position and disengage the operating handle in a disengaged position; and a first lock arranged to secure said slider member and said handle block in the engaged position, wherein said slider member includes a base, a first leg extending from said base and an arm extending from said first leg, said arm having an aperture and further including a cam link having a first end, said cam link operably connected to said first lock, wherein said aperture in said arm of said slider member configured to receive said first end of said cam link.

19. The circuit breaker of claim 18 wherein said handle block is positioned to abut said operating handle in a first and a second engaged position, wherein said handle block prevents said operating handle from moving from the ON position to the OFF position when said handle block is in the first engaged position and prevents said operating handle from moving from the OFF position to the ON position when said handle block is in the second engaged position.

20. The circuit breaker of claim 18 wherein said yoke member includes a first aperture and said first lock is mounted within said first aperture of said yoke member.

21. The circuit breaker of claim 18 wherein said base member includes a first arm extending from one end of said base member and a second arm extending from an opposite end of said base member and adapted to cover a push-to-trip button on the housing, wherein said second arm prevents said push-to-trip button from being depressed, said second arm contains lines of weakness for removing said second arm from said base member.

22. The circuit breaker of claim 18 wherein said arm is U-shaped and inwardly extending.

23. The circuit breaker of claim 21 wherein said base member is formed from plastics material.

24. The circuit breaker of claim 23 wherein said base member includes a first arm extending from one end of said base member and a second arm extending from an opposite end of said base member, said second arm covers said push-to-trip button on the housing, wherein said second arm contains lines of weakness for removing said second arm from said base member.

25. The circuit breaker of claim 24 wherein said second arm is generally planar.

26. The circuit breaker of claim 18 wherein said first lock is a figure lock.

27. The circuit breaker of claim 18 wherein said yoke member includes a base section and a first leg extending from said base section, said first leg having a first padlock aperture, and further wherein said slider member includes a second leg having a first padlock aperture configured to align with said first padlock aperture in said yoke member for receiving said first lock for securing said slider member and said handle block in the engaged position.

28. The circuit breaker of claim 27 wherein said first lock is a padlock.

29. The circuit breaker of claim 18 wherein said handle block includes an aperture and wherein said slider member includes an aperture, said aperture in said handle block configured to align with said aperture in said slider member for insertion of a mechanical fastener.

30. The circuit breaker of claim 18 wherein said cam link includes an aperture, said first lock inserted through said aperture of said cam link.

31. The circuit breaker of claim 18 further including a fastener connected to said cam link, said fastener arranged to secure said first end of said cam link in said first aperture of said arm.

32. The circuit breaker of claim 18 wherein said handle block having a plurality of apertures and said slider member having a plurality of apertures wherein one of said plurality of apertures in said slider member selectively aligned with one of said plurality of apertures in said handle block to abut said handle block against the operating handle in the engaged position.

33. The locking device of claim 21 wherein said base member having an aperture for receiving a mechanical fastener to fixedly attach said base member to the housing and further wherein said yoke member covers said aperture of said base member to prevent access to said aperture of said base member when the locking device is locked in the engaged position.

34. The locking device of claim 21 wherein said yoke member having an aperture for receiving a mechanical fastener to fixedly attach said yoke member to said base member and further wherein said slider member covers said aperture of said yoke member to prevent access to said aperture of said yoke member when the locking device is locked in the engaged position.

* * * * *